United States Patent [19]

Levin et al.

[11] 4,037,128

[45] July 19, 1977

[54] THREE-PHASE DISCHARGE LAMP

[76] Inventors: Izrail Aronovich Levin, 16 Parkovaya ulitsa 55, korpus 2, kv. 43; Jury Pavlovich Potemkin, ulitsa Ljublinskaya 17, stroenie 3, kv. 32; Igor Pavlovich Slobodskoi, Pechatnikov pereulok 13, kv. 28; Alexandr Mikhailovich Troitsky, Tsvetnoi bulvar 22, kv. 64; Ivan Vasilievich Sapozhnikov, ulitsa Baikalskaya 42, korpus 2, kv. 22, all of Moscow, U.S.S.R.

[21] Appl. No.: 612,919

[22] Filed: Sept. 12, 1975

[51] Int. Cl.[2] ..... H01J 61/06

[52] U.S. Cl. ..... 313/188; 313/214; 313/224; 313/225; 313/229; 313/198

[58] Field of Search ..... 313/188, 214, 224, 225, 313/229

[56] References Cited

U.S. PATENT DOCUMENTS 3,780,331 12/1973 Knochel et al. ..... 313/219

FOREIGN PATENT DOCUMENTS 105,858 12/1938 Australia ..... 313/188

*Primary Examiner*—Rudolph V. Rolinec
*Assistant Examiner*—Darwin R. Hostetter
*Attorney, Agent, or Firm*—Fleit & Jacobson

[57] ABSTRACT

A three-phase discharge lamp is proposed the bulb of which comprises four main electrodes forming three discharge gaps disposed in sequence along the axis of the bulb. In such a lamp, luminous substance is extended along the lamp axis and may be practically of any desired shape with the same luminous intensity throughout the length of the lamp.

26 Claims, 8 Drawing Figures

THREE-PHASE DISCHARGE LAMP

The present invention relates broadly to discharge lamps and more particularly to low-, high-and super-high-pressure three-phase lamps used for general, local or special illumination-mercury-vapor, sodium-vapor, metal halide-vapor or xenon lamps.

The luminous flux of single-phase discharge lamps is subject to considerable pulsations which may reach 65–75%. These pulsations cause a stroboscopic effect when illuminating moving objects, reduce operating efficiency when used for illuminating production buildings, and cause discomfort in illumination of living apartments.

To minimize the pulsations of the luminous flux so as to practically completely eliminate these adverse effects, single-phase lamps may be connected to three different phases of three-phase mains, or three-phase lamps may be used.

In a known three-phase discharge lamp, a bulb which is coated on the inside with fluorescent material contains three high-pressure burners which are connected to three-phase mains through chokes.

However, the arrangement of three single-phase burners in one bulb increases too much the size of the lamp. Besides, the luminous efficiency and the life time of such a lamp are less than in a single-phase lamp, since the burners are mutually overshowed and heated.

Another prior art three-phase discharge lamp comprises a bulb filled with inert gas, inert gas in combination with metal vapors or inert gas in combination with vapors of metals and metal halides, which contains main electrodes forming three discharge gaps and having current connections.

This known lamp has three convergent taps which carry at their ends main electrodes forming three star-shaped discharge gaps, two taps being disposed in parallel in order to minimize the width of the lamp.

The above lamp possesses a number of important disadvantages which handicap its manufacture and operation.

Thus, a high complexity of the lamp configuration renders the lamp difficult to manufacture, and makes its manufacture process practically unfeasible for mechanization.

The radiation of the lamp is asymmetrical to a considerable degree, and its luminous efficiency and life time are less than those in a single-phase lamp, since two taps overshadow and heat each other. It is difficult to design an effective lighting fixture for such a lamp because of the difficulties involved in redistributing its irregular radiation and because an outside bulb (if any) must be of a large diameter. All these factors make manufacture of a high-power lamp an extremely complicated process.

On account of the above drawbacks inherent in known three-phase lamps, three-phase discharge lamps are not serially produced at the present time.

It is an object of the present invention to provide a three-phase discharge lamp with luminous substance of a simple shape.

To accomplish the foregoing object, a three-phase discharge lamp comprising a bulb filled with inert gas, inert gas in combination with vapour of metals and metal halides and containing main electrodes that form three discharge gaps and have current connections, comprises, according to the invention, four main electrodes and three discharge electrodes formed by these four main gaps and disposed in sequence along the axis of the lamp.

It is preferable that discharge gaps disposed in sequence are of equal length.

It is also preferable that a lamp has at least one ignitor electrode disposed in the immediate proximity of one of the four main electrodes.

It is desirable that the current connections of the four main electrodes are arranged in pairs so that the electrodes located at a distance from the connections, are electrically coupled thereto through crosspieces with an insulation coating.

A proposed three-phase discharge lamp is simple in design. The luminous substance in the lamp is extended along its axis and may be of practically any desired shape. The luminous flux emitted by the lamp is distributed regularly along its length.

The present invention will become more readily understood from a consideration of the following detailed description of preferred embodiments thereof when taken together with the accompanying drawings, in which.

Figure 1:
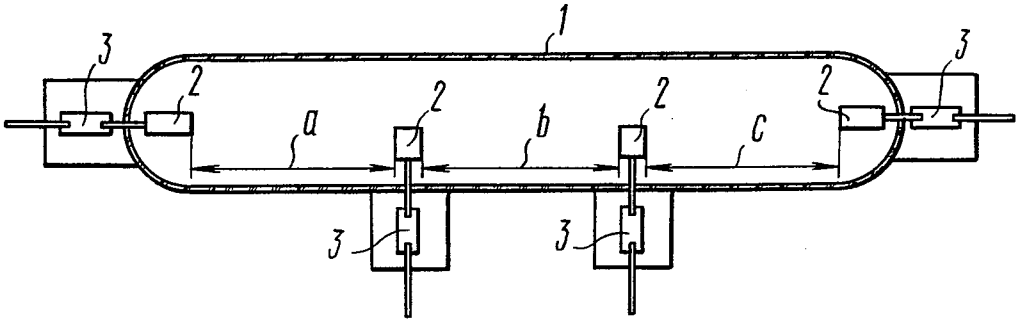
FIG. 1 is a first embodiment of a proposed three-phase discharge lamp with a rectilinear cylindrical bulb and discharge gaps of different lengths.

A three-phase discharge lamp of the present invention comprises a bulb 1 (FIG. 1) with four main electrodes 2. In the embodiment being described the bulb 1 is made of quartz glass and is of a rectilinear cylindrical shape. The electrodes 2 have foil current connectors 3 soldered into the quartz glass of the bulb 1 and are disposed inside the bulb 1 in such a way that three resulting discharges gaps *a, b* and *c* are arranged in sequence along the axis of this bulb 1.

In this embodiment of the invention, the bulb 1 is filled with argon, mercury vapors and metal halide vapors.

Other embodiments of the invention may have a bulb filled with any inert gas or inert gas in combination with metal vapors.

In a three-phase discharge lamp of this design, luminous substance is extended along the rectilinear axis of the lamp and provides a luminous flux uniformly distributed in the lamp lengthwise. As a result, the lamp is highly effective in use and a lighting fixture for this lamp may be of a simple configuration which is also of importance for its economic efficiency.

Figure 2:
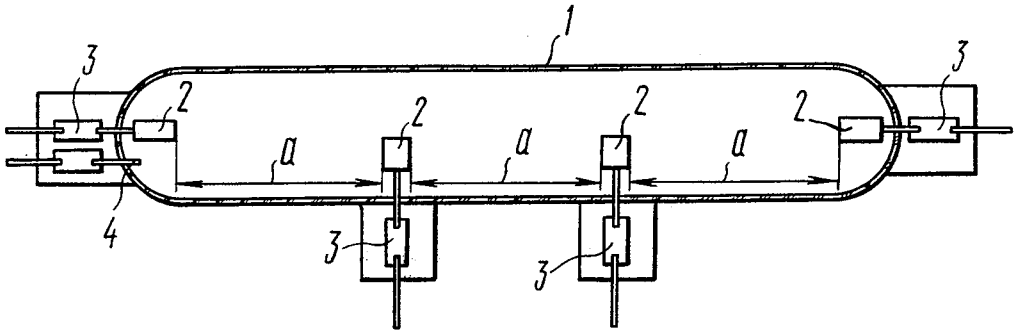
FIG. 2 is a second embodiment of a proposed three-phase discharge lamp with equal-length discharge gaps and with an ignitor electrode.

Another embodiment of a three-phase discharge lamp is similar to the above, with the difference that the discharge gaps *a* (FIG. 2) are of equal length.

In this embodiment, with the same electric power across all the three discharge gaps *a* of the lamp, the unit load on the walls of its bulb 1 is equal at a constant cross section of the bulb 1. Such a design of the lamp facilitates its manufacture technology and increases its life time.

In still another embodiment of the invention, two discharge gaps are equal, while the third gap is of different length. This design may be useful for calculating the actual length of arcs when the lamp operates in a horizontal position or for increasing the stability of lamp operation in different power supply circuits.

For easier ignition, the lamp comprises an ignitor electrode 4 disposed in the immediate proximity of one of the main electrodes 2.

Embodimens are also possible in which a lamp comprises two, three or four ignitor electrodes.

According to the invention, there may be a third embodiment of a three-phase discharge lamp which is similar to those described above.

Figure 3:
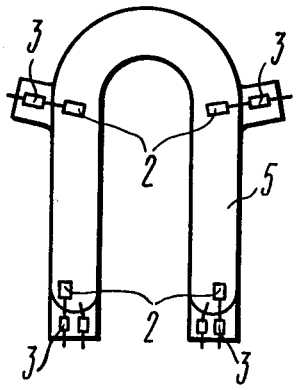
FIG. 3 is a third embodiment of a proposed three-phase discharge lamp with a U-shaped bulb.

This embodiment is different in that a bulb 5 (FIG. 3) is U-shaped which makes it possible, if so required, to reduce the length of the lamp.

A fourth embodiment of the invention similar to the above is also possible.

Figure 4:
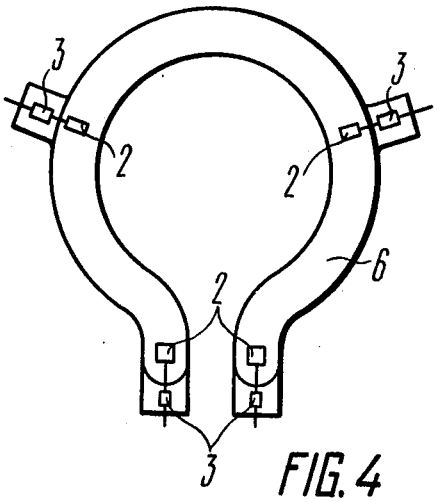
FIG. 4 is a fourth embodiment of a proposed three-phase discharge lamp with a circular bulb.

This embodiment differs from the above in that it has a circular bulb 6 (FIG. 4).

The third and the fourth embodiments are particularly advantageous when the lamp is employed in projection equipment, because this shape of the lamp permits a reduction in the size of the reflector.

Figure 5:
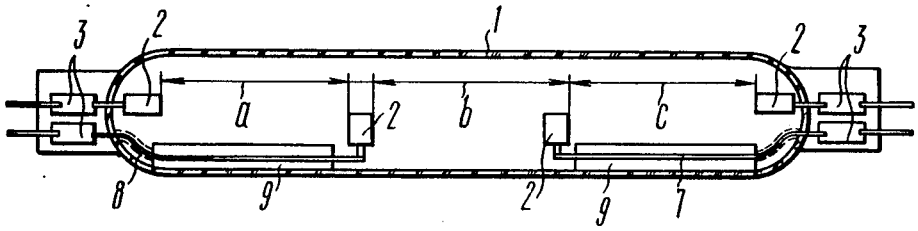
FIG. 5 is a fifth embodiment of a proposed three-phase discharge lamp with current connections of the main electrodes disposed in pairs.

According to the invention, a fifth embodiment of a three-phase discharge lamp is also possible. In this embodiment, the current connections 3 (FIG. 5) of the main electrodes 2 are arranged in pairs at the ends of the bulb 1, and the main electrodes 2 located at some distance from the current connections 3 are coupled thereto through crosspieces 7 with an insulation coating. Sections of quartz tubes 9 fitted onto the crosspieces 7 are soldered to the quartz bulb 1 to fix the position of the main electrodes 2.

An embodiment of the invention may be provided where glass or quartz beads are fitted onto the crosspieces and adhered or soldered to the bulb made from the same material.

In still another embodiment of the invention, the current connections of the main electrodes are arranged in pairs on the side surfaces of the bulb 1 rather than on the end surfaces thereof.

These embodiments simplify appreciably the lamp manufacture technology and make it possible to reduce the width of the lamp (which is particularly important if the lamp has an outside envelope) or its length, and to provide more precise spacings between the main electrodes. Such an arrangement of the current connections may also be used in a lamp with a U-shaped or circular bulb instead of a cylindrical bulb.

In all the above embodiments, the bulb may have an outside envelope which may be coated with fluorescent material with a view to correcting chromaticity or to increasing the luminous efficiency of the lamp.

Figure 6:
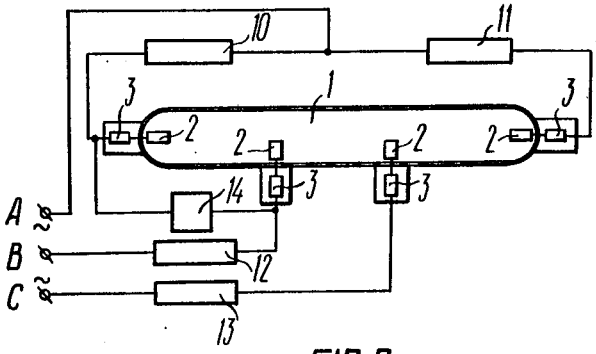
FIG. 6 is a schematic diagram of the power supply circuit of a proposed three-phase discharge lamp without ignitor electrodes.

The above three-phase discharge lamp comprising no ignition electrodes may be supplied through a circuit composed of four reactive ballast elements 10, 11, 12 and 13 (FIG. 6). Power supply of the main electrodes 2 disposed at the ends of the lamp is via the two reactive elements 10 and 11 with the common junction thereof connected to one phase A of the mains; each of the other two main electrodes 2 positioned between the end main electrodes is fed through the reactive elements 12 and 13 from two other mains phases B and C.

In this embodiment, for easier lamp ignition high-voltage pulses are applied to one discharge gap of the lamp from a special high-voltage pulse generator 14 which is a well known circuit (see, for example "Electrical circuits with discharge lamps" by M. I. Fugenfirov, "Energiya" Publishers, Moscow, 1974).

It is also possible to provide embodiments of the invention where high-voltage pulses from special igniting devices are applied to two or all the three discharge gaps of the lamp.

An advantage of this supply circuit is that it obviates the need for using ignitor electrodes in the lamp. This is particularly important for metal halide-vapor and sodium-vapor lamps in which an ignitor electrode is often objectionable.

Power supply of a three-phase discharge lamp with ignitor electrodes is effected as described above.

The only difference is that instead of the high-voltage pulse generator 14, the lamp comprises limiting resistors 15 (FIG. 7) connected between the ignitor electrode 4 and the current connection 3 of one of the main electrodes 2 located at a distance from this ignitor electrode 4.

Depending on the number of ignitor electrodes, the circuit may comprise one, two, three or four such limiting resistors.

The advantage of this power supply circuit of the lamp is that no special high-voltage pulse generator is necessary and that no high-voltage pulses which impose particular restrictions on the connecting elements of the lamp, are used in the circuit.

The above three-phase discharge lamp may also be supplied through a circuit similar to that illustrated in FIG. 6.

Figure 8:
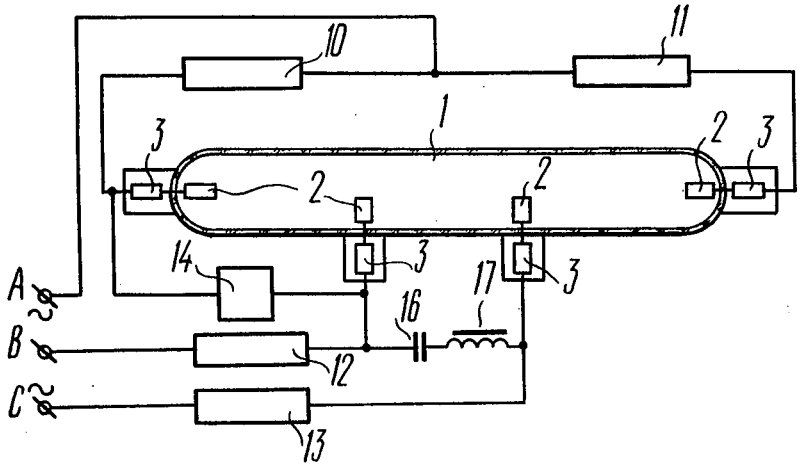
FIG. 8 is the same as FIG. 3, with a capacitor shunting the discharge gap of the lamp.

A characteristic feature of this power supply circuit is that one of the discharge gaps of the lamp is shunted by a capacitor 16 (FIG. 8) through a choke 17. The capacitor 16 may also shunt the discharge gap of the lamp without the choke 17, but in this case operating conditions for the main electrodes 2 will be degraded.

An embodiment of the invention may be contemplated in which the capacitor 16 shunts the discharge gap of the lamp through part of the winding of a choke in the respective reactive ballast element 10, 11, 12, 13.

In some embodiments, two or all the three discharge gaps of the lamp are shunted by capacitors.

Figure 7:
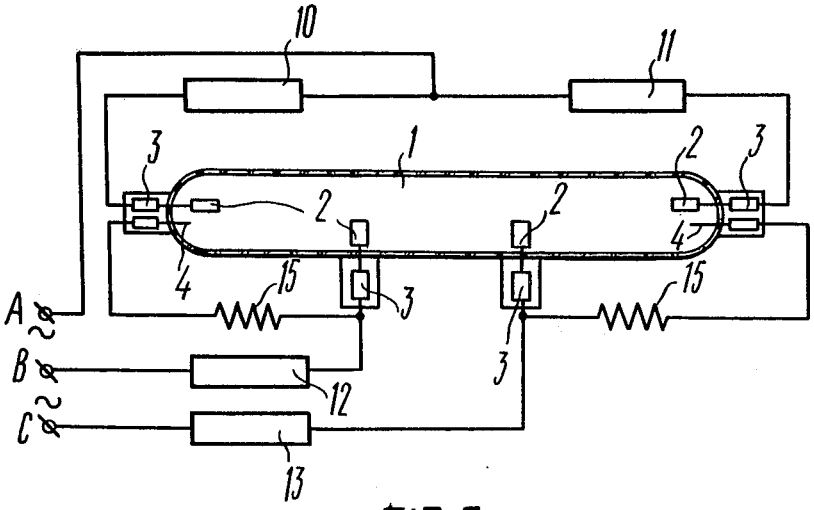
FIG. 7 is a schematic diagram of the power supply circuit of a proposed three-phase discharge lamp with an ignitor electrode.

The above embodiment of the power supply circuit improves the operating stability of the lamp and thereby provides a more advantageous ratio of the operating voltage across the discharge gap to the mains voltage. It can be used both for a lamp without ignitor electrodes (in this case the circuit comprises special high-voltage pulse generators connected as shown in FIG. 6) and for a lamp with ignitor electrodes (then the circuit will contain limiting resistors connected as shown in FIG. 7).

The reactance of the shunting capacitor must be 3–15 times larger than the sum total of the inductive reactances of ballast elements connected in the circuit of a given discharge gap.

A three-phase discharge lamp in all the embodiments of the invention operates as follows.

Three-phase current applied to the lamp from a power supply source causes first an auxiliary discharge between the ignitor electrode 4 (FIG. 7) and the adjacent main electrode 2. The auxiliary discharge facilitates initiation of the main arc discharge in all the three discharge gaps of the lamp.

If a lamp comprises no ignitor electrodes, initiation of the main arc discharge is facilitated by applying high-voltage pulses to one, two or all the three discharge gaps of the lamp.

After the main discharge has passed through all the three discharge gaps of the lamp, pressure in the bulb 1 gradually goes up due to an increase of temperature inside the bulb 1. If the lamp is filled with inert gas mixed with mercury, sodium or metal halide vapors, the pressure of the vapors increases in the course of lamp ignition. This process practically repeats the phenomena which take place in single-phase lamps.

In a steady-state mode of operation, pulsation of the radiation from each main discharge gap of a lamp has a time shift with respect to radiation pulsation of the two other discharge gaps. By virtue of this fact, the total pulsation of fluorescent radiation of the lamp is much lower than the pulsation of each individual discharge gap.

The proposed design of a three-phase discharge lamp can be used for manufacturing mercury-vapor, metal halide-vapor, sodium-vapor or xenon lamps within practically any power range.

The luminous substance of a proposed three-phase discharge lamp is extended along the axis of the lamp and may be of practically any desired shape, for example, rectilinear, circular or U-shaped.

The lamp emits a luminous flux which is uniform along its entire length. Due to this, the lamp may be used in effective, simple and cheap lighting fixtures. The pulsation of the luminous flux in three-phase discharge lamps may be considerably reduced as compared with the pulsation of the luminous flux in single-phase lamps. The pulsation of the luminous flux in a proposed lamp may reach a value which is not in excess of luminous flux pulsation in filament lamps.

A simple design of a proposed three-phase lamp permits mechanization of its manufacture, makes it possible to increase the unit power of the lamp three-fold and to employ simple mass-manufactured structural elements and simple manufacture technology in production of this lamp.

What is claimed is:

1. A three-phase discharge lamp, comprising: a bulb having a longitudinal axis; inert gas filling said bulb; four main electrodes fastened in said bulb; three discharge gaps formed by said four main electrodes, said discharge gaps, disposed in sequence along said axis of said bulb.

2. A lamp as set forth in claim 1 in which said discharge gaps are of equal length.

3. A lamp as set forth in claim 1 which comprises at least one ignitor electrode disposed in the immediate proximity of one of said main electrodes.

4. A lamp as set forth in claim 1, comprising: current connections of said main electrodes, said current connections arranged in pairs; crosspieces through which said main electrodes disposed at some distance from said current connections are electrically coupled thereto; an insulation coating of said crosspieces.

5. A lamp as set forth in claim 2 which comprises at least one ignitor electrode disposed in the immediate proximity of one of said main electrodes.

6. A lamp as set forth in claim 2, comprising: current connections of said main electrodes, said current connections arranged in pairs; crosspieces through which said main electrodes disposed at some distance from said current connections are electrically coupled thereto; an insulation coating of said crosspieces.

7. A lamp as set forth in claim 3, comprising: current connections of said main electrodes, said current connections arranged in pairs; crosspieces through which said main electrodes located at some distance from said current connections are electrically coupled thereto; an insulation coating of said crosspieces.

8. A three-phase discharge lamp, comprising: a bulb having a longitudinal axis; inert gas in combination with metal vapors filling said bulb; four main electrodes fastened in said bulb; three discharge gaps formed by said four main electrodes and disposed in sequence along said axis of said bulb.

9. A lamp as set forth in claim 8 in which said discharge gaps are of equal length.

10. A lamp as set forth in claim 8 which comprises at least one ignitor electrode disposed in the immediate vicinity of one of said main electrodes.

11. A lamp as set forth in claim 8, comprising: current connections of said main electrodes, said current connections arranged in pairs; crosspieces through which said main electrodes disposed at some distance from said current connections are electrically coupled thereto; an insulation coating of said crosspieces.

12. A lamp as set forth in claim 9 which comprises at least one ignitor electrode disposed in the immediate proximity of one of said main electrodes.

13. A lamp as set forth in claim 9, comprising: current connections of said main electrodes, said current connections arranged in pairs; crosspieces through which said main electrodes disposed at some distance from said current connections are electrically coupled thereto; an insulation coating of said crosspieces.

14. A lamp as set forth in claim 10, comprising: current connections of said main electrodes, said current connections arranged in pairs; crosspieces through which said main electrodes disposed at some distance from said current connections are electrically coupled thereto; an insulation coating of said crosspieces.

15. A three-phase discharge lamp, comprising: a bulb having a longitudinal axis; inert gas in combination with vapors of metals and metal halides filling said bulb; four main electrodes fastened in said bulb; three discharge gaps formed by said four main electrodes and disposed in sequence along said axis of said bulb.

16. A lamp as set forth in claim 15 in which said discharge gaps are of equal length.

17. A lamp as set forth in claim 15 which comprises at least one ignitor electrode disposed in the immediate proximity of one of said main electrodes.

18. A lamp as set forth in claim 15, comprising: current connections of said main electrodes said current connections arranged in pairs; crosspieces through which said main electrodes disposed at some distance from said current connections are electrically coupled thereto; an insulation coating of said crosspieces.

19. A lamp as set forth in claim 16 which comprises at least one ignitor electrode disposed in the immediate proximity of one of said main electrodes.

20. A lamp as set forth in claim 16, compising: current connections of said main electrodes, said current connections arranged in pairs; crosspieces through which said main electrodes disposed at some distance from said current connections are electrically coupled thereto; an insulation coating of said crosspieces.

21. A lamp as set forth in claim 17, comprising: current connections of said main electrodes, said current connections arranged in pairs; crosspieces through which said main electrodes arranged in pairs; crosspieces through which said main electrodes disposed at some distance from said current connections are electrically coupled thereto; an insulation coating of said crosspieces.

22. A lamp as set forth in claim 1 wherein two discharge gaps are equal, while the third discharge gap is of a different length.

23. A lamp as set forth in claim 1 further comprising means for interconnecting said four main electrodes with a three-phase power source.

24. A lamp as set forth in claim 23 wherein two of said main electrodes are connected to one phase of the three-phase power source, and each of the other two main electrodes are connected to a second and third phase, respectively, of said three-phase power source, and reactive elements are connected in series between the power source and the electrodes.

25. A lamp as set forth in claim 24 wherein said two main electrodes connected to one phase are positioned at opposite ends of the bulb.

26. A lamp as set forth in claim 23 further comprising a pulse generator connected to one of said four main electrodes.

* * * * *